US009707578B2

(12) United States Patent
Meier et al.

(10) Patent No.: US 9,707,578 B2
(45) Date of Patent: Jul. 18, 2017

(54) ROTARY ATOMIZER NOZZLE HEAD, AND ROTARY ATOMIZER WITH SUCH A NOZZLE HEAD

(71) Applicant: EISENMANN SE, Böblingen (DE)

(72) Inventors: Ralph Meier, Waldenbuch (DE); Claus Lang-Koetz, Stuttgart (DE); Jan Reichler, Constance (DE); Thomas Kalmbach, Stuttgart (DE); Manuel Liebing, Filderstadt (DE); Markus Hauber, Kornwestheim (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 14/404,207

(22) PCT Filed: May 16, 2013

(86) PCT No.: PCT/EP2013/001451

§ 371 (c)(1),
(2) Date: Nov. 26, 2014

(87) PCT Pub. No.: WO2013/178327

PCT Pub. Date: Dec. 5, 2013

(65) Prior Publication Data

US 2015/0140235 A1 May 21, 2015

(30) Foreign Application Priority Data

May 30, 2012 (DE) ..... 10 2012 010 610

(51) Int. Cl.
*B05B 3/10* (2006.01)
*B05B 7/08* (2006.01)
(Continued)

(52) U.S. Cl.
CPC ..... *B05B 3/1014* (2013.01); *B05B 3/105* (2013.01); *B05B 3/1064* (2013.01);
(Continued)

(58) Field of Classification Search
None
See application file for complete search history.

(56) References Cited

U.S. PATENT DOCUMENTS 2,861,628 A * 11/1958 Fraser ..... B05B 7/0458 239/132.3
5,078,321 A * 1/1992 Davis ..... B05B 3/1014 239/224
(Continued)

FOREIGN PATENT DOCUMENTS

DE 198 53 710 A1 5/1999
DE 10 2010 053 134 A1 6/2012
(Continued)

OTHER PUBLICATIONS

Mescher et al., "Gravity Affected Break-Up of Laminar Threads at Low Gas-Relative-Velocities," Chem. Eng. Sci., vol. 69, Issue 1, Feb. 13, 2012, pp. 181-192.

*Primary Examiner* — Binu Thomas
(74) *Attorney, Agent, or Firm* — Factor Intellectual Property Law Group, Ltd.

(57) ABSTRACT

A bell plate is rotated about a rotational axis, and coating material is supplied to a discharge surface of the bell plate such that the coating material is projected away from the bell plate. A working fluid is blown at least temporarily as a transonic or supersonic flow onto the coating material coming from the bell plate by means of a dispensing device. Furthermore, a spray head for a rotary atomizer is provided for applying a coating material to an object, having a bell plate which can be rotated about a rotational axis and which has a discharge surface, wherein coating material can be supplied to the discharge surface such that the coating material is projected away from the bell plate. A dispensing device which can blow a working fluid at least temporarily as a transonic or supersonic flow onto the coating material coming from the bell plate.

9 Claims, 4 Drawing Sheets

(51) Int. Cl.
*B05B 5/04* (2006.01)
*B05D 1/02* (2006.01)

(52) U.S. Cl.
CPC ..... *B05B 3/1092* (2013.01); *B05D 1/02* (2013.01); *B05B 5/0426* (2013.01); *B05B 7/0815* (2013.01)

(56) References Cited

U.S. PATENT DOCUMENTS

| | | | | |
|---|---|---|---|---|
| 5,862,988 | A * | 1/1999 | van der Steur ..... | B05B 7/0815 239/224 |
| 5,894,993 | A | 4/1999 | Takayama et al. | |
| 6,053,428 | A | 4/2000 | Van Der Steur | |
| 7,322,793 | B2 | 1/2008 | Baumann et al. | |
| 2004/0164190 | A1 | 8/2004 | Baumann et al. | |
| 2005/0136190 | A1 | 6/2005 | Tani et al. | |
| 2008/0290193 | A1 | 11/2008 | Hursen | |
| 2009/0020626 | A1 | 1/2009 | Seitz | |

FOREIGN PATENT DOCUMENTS

| | | | |
|---|---|---|---|
| EP | 1 384 516 | A2 | 1/2004 |
| EP | 1 923 138 | B1 | 5/2008 |
| EP | 2 460 591 | A1 | 6/2012 |
| GB | 1 242 342 | A | 8/1971 |
| JP | H09-94488 | A | 4/1997 |

* cited by examiner

ROTARY ATOMIZER NOZZLE HEAD, AND ROTARY ATOMIZER WITH SUCH A NOZZLE HEAD

RELATED APPLICATIONS

This application is a national phase of International Patent Application No. PCT/EP2013/001451, filed May 16, 2013, which claims the filing benefit of German Patent Application No. 10 2012 010 610.6, filed May 30, 2012, the contents of both of which are incorporated herein by reference.

FIELD OF THE INVENTION

The invention relates to a method for operating a rotary atomizer, with which a coating material is applied to an object, in which a bell disc is rotated about a rotational axis and coating material is supplied to a flow-off surface of the bell disc in such a way that coating material is hurled away from the bell disc.

Furthermore, the invention relates to a nozzle head for a rotary atomizer for applying a coating material to an object having a bell disc which is rotatable about a rotational axis and has a flow-off surface which can be supplied with coating material in such a way that coating material is hurled away from the bell disc;

The invention further relates to a rotary atomizer for applying a coating material to an object having a nozzle head.

Rotary atomizers which are equipped with a nozzle head of the type mentioned are used, for example, in the automotive industry in order to paint objects, such as parts of vehicle bodies or coat them with a protective material.

The bell disc serves in this case for atomizing the coating material, for which purpose, in operation, it is rotated at very high rotational speeds of 10,000 to 100,000 rpm about its rotational axis.

The selected coating material is supplied to the rotating bell disc. On account of centrifugal forces acting on the coating material, it is propelled outwards on the bell disc as a film until it reaches a radially outer breakaway edge of the bell disc. There such high centrifugal forces act on the coating material that it is hurled away tangentially in the form of fine coating material droplets.

There result droplets with different sizes extending over a comparatively wide size range. Larger droplets here are hurled radially further outwards than smaller droplets. With nozzle heads and rotary atomizers of the type mentioned at the outset, there is thus produced a relatively broad spray jet which is ideally conical and has a comparatively large cone angle.

In this case, it is desirable for the size of the droplets to be comparatively uniform and the droplet spectrum in terms of the size to extend only over a range as small as possible. Furthermore, the droplets should be as small as possible, since a more homogeneous coating result is achieved with smaller droplets.

BACKGROUND OF THE INVENTION

A measure of the droplet size distribution and thus of the droplet spectrum of the spray jet is, for example, the so-called span value, as is described inter alia in Mescher et al., Gravity affected break-up of laminar threads at low gas-relative-velocities, Chem. Eng. Sci., Volume 69, Issue 1, 13 Feb. 2012, pages 181-192.

The slower the bell disc is rotated, the larger, on average, are the droplets which are hurled away from the breakaway edge.

Accordingly, at higher rotational speeds of the bell disc, on average smaller droplets are produced at the breakaway edge of the bell disc. For this reason, the bell disc is generally operated at high rotational speeds, which involves a correspondingly high energy consumption. At the same time, the radial spreading of the spray jet is, in turn, greater at higher rotational speeds of the bell disc than at lower rotational speeds, so that measures have to be taken to focus this spray jet onto the objects to be coated.

For this purpose, known rotary atomizers operate, for example, electrostatically. In this case, the coating material to be applied is charged, whereas the object to be coated is earthed. During this, an electrical field is formed between the rotary atomizer and the object, by which the charged coating material is applied to the object in a directed manner. However, this works only with electrically conductive objects.

Alternatively or additionally to the electrostatic operation, directing air devices have become established in known rotary atomizers. With these devices, a mostly annular directing air stream is guided onto the spray jet such that the latter is focused and the droplets of different size are guided in a directed manner onto the object to be coated.

For this purpose, however, in some cases strong directing air streams are necessary, the generation of which with known means is relatively costly.

SUMMARY OF THE INVENTION

An object of the invention is to provide a method, a nozzle head and a rotary atomizer of the type mentioned at the outset, which enable an energy-efficient operation of the rotary atomizer with a spray jet as homogeneous and focused as possible.

This object may be achieved in the case of the method of the type mentioned at the outset in that a working fluid is blown at least temporarily as a transonic or supersonic flow onto coating material coming from the bell disc by means of a discharge device.

Coating material coming from the bell disc includes in the present case both coating material which has already separated from the bell disc and has been hurled away from the latter, and also coating material which still adheres to the bell disc. For example, the latter may comprise coating material which is in the process of separating from the breakaway edge of the bell disc. In this case, in a manner known per se, jets or lamellae form at the breakaway edge and from these the droplets then develop.

In the present case, a transonic flow is to be understood as a flow with a Mach number Ma of 0.8 to 1.2. Such a flow is also referred to as a flow near the speed of sound. A supersonic flow has a Mach number Ma of more than 1.2.

Through this measure, there is produced an impressed disturbance with regard to the coating material which can influence the droplet formation.

Preferably, the working fluid is blown in the direction of a breakaway edge of the bell disc and further preferably onto coating material separating from a breakaway edge of the bell disc; the material is in the form of the above-mentioned jets or lamellae. There the working fluid as an impressed disturbance influences the instability of the jets or of the lamellae and thus the droplet formation in the development process. This impressed disturbance results in an increased formation of smaller droplets with a moderate droplet spectrum. Thus, even at low rotational speeds of the bell disc, at least fewer larger and thus heavier droplets are present, which at the same rotational speed would be carried, due to centrifugal forces, further radially outwards than smaller and thus lighter paint droplets. At the same time, also at lower rotational speeds, the paint mist is effectively focused onto the object to be painted.

In the case of the nozzle head, the above-mentioned object may be achieved with the same advantages in that a discharge device is present, by means of which a working fluid can be blown at least temporarily as a transonic or supersonic flow onto coating material coming from the bell disc.

For the reasons already mentioned above, the discharge device is preferably configured in such a way that the working fluid is blown in the direction of a breakaway edge of the bell disc.

In this case, it is favourable when the discharge device is configured in such a way that the working fluid is blown onto coating material separating from a breakaway edge of the bell disc.

When the discharge device comprises a Laval nozzle unit having an annular discharge gap or a plurality of discharge openings, this supports effectively the generation of a transonic or supersonic flow.

In the case of a Laval nozzle, the passage cross-section for a working fluid flowing through initially narrows and then widens again in the direction of an outlet opening. As a result, the working fluid flowing through can be greatly accelerated without further measures being required for this. This has already been described in the German patent application with the application number 10 2010 053 134.0.

The generation of the transonic or supersonic flow can be supported additionally by a fluid source, from which the Laval nozzle unit can be supplied with the working fluid under positive pressure. As a result, the working fluid flows already at high speed to the Laval nozzle unit, where it is then accelerated still further.

It is favourable when the outer lateral surface of the bell disc is surrounded by an inner lateral surface of a guiding body, which surface forms with the outer lateral surface of the bell disc a Laval annular nozzle. In this way, the outer lateral surface of the bell disc can be utilised as a flow surface of the Laval annular nozzle. The term Laval annular nozzle is intended, in the present case, to describe an annular nozzle having an annular discharge gap instead of a conventional axial nozzle opening. In this nozzle, the passage cross-section of the annular discharge gap initially narrows for a working fluid flowing through and then widens again in the direction of an annular outlet gap.

In this case, it is advantageous when an annular channel is present between the bell disc and the guiding body, an annular gap which defines the narrowest point of the annular channel furthermore being formed between the inner lateral surface of the guiding body and the outer lateral surface of the bell disc.

Alternatively, the bell disc can be surrounded by a first, inner guiding body and the inner guiding body can be surrounded by a second, outer guiding body, and an outer lateral surface of the inner guiding body can form with an inner lateral surface of the outer guiding body a Laval annular nozzle.

In this case, it is favourable when an annular channel is present between the inner guiding body and the outer guiding body, an annular gap which defines the narrowest point of the annular channel being formed between an outer lateral surface of the inner guiding body and an inner lateral surface of the outer guiding body.

A further favourable alternative is realised when the bell disc is surrounded by a Laval annular body which has a plurality of Laval nozzle openings. Here, the Laval nozzle unit does not have an annular gap, but a plurality of nozzle openings from which the transonic or supersonic flow is blown onto the coating material. Put another away, the Laval annular body is thus formed from a multiplicity of individual Laval nozzles which are arranged along the annular path.

A geometrically favourable form is ensured when the outer lateral surface of the bell disc forms a truncated cone surface.

It is furthermore advantageous when in an annular channel present there are arranged guide vanes which are configured such that, on rotation of the bell disc and/or a guiding body, working fluid situated in the annular channel is conveyed to the annular discharge gap or, where present, to the plurality of Laval nozzle openings of the Laval nozzle unit. As a result, the acceleration of the working fluid can, alternatively or additionally, be supported. Depending on the setting angle of the guide vanes, the transonic or supersonic flow can pick up an azimuthal speed component, whereby the relative speed of the transonic or supersonic flow to the speed of the coating material separating from the bell disc is influenced. The above-mentioned span value and thus the droplet spectrum of the spray jet can also be influenced via this.

With regard to the rotary atomizer of the type mentioned at the outset, the above-mentioned object may be achieved in that the nozzle head is formed with some or all of the above-mentioned features.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawings, in which.

DETAILED DESCRIPTION OF THE PRESENT INVENTION

Figure 1:
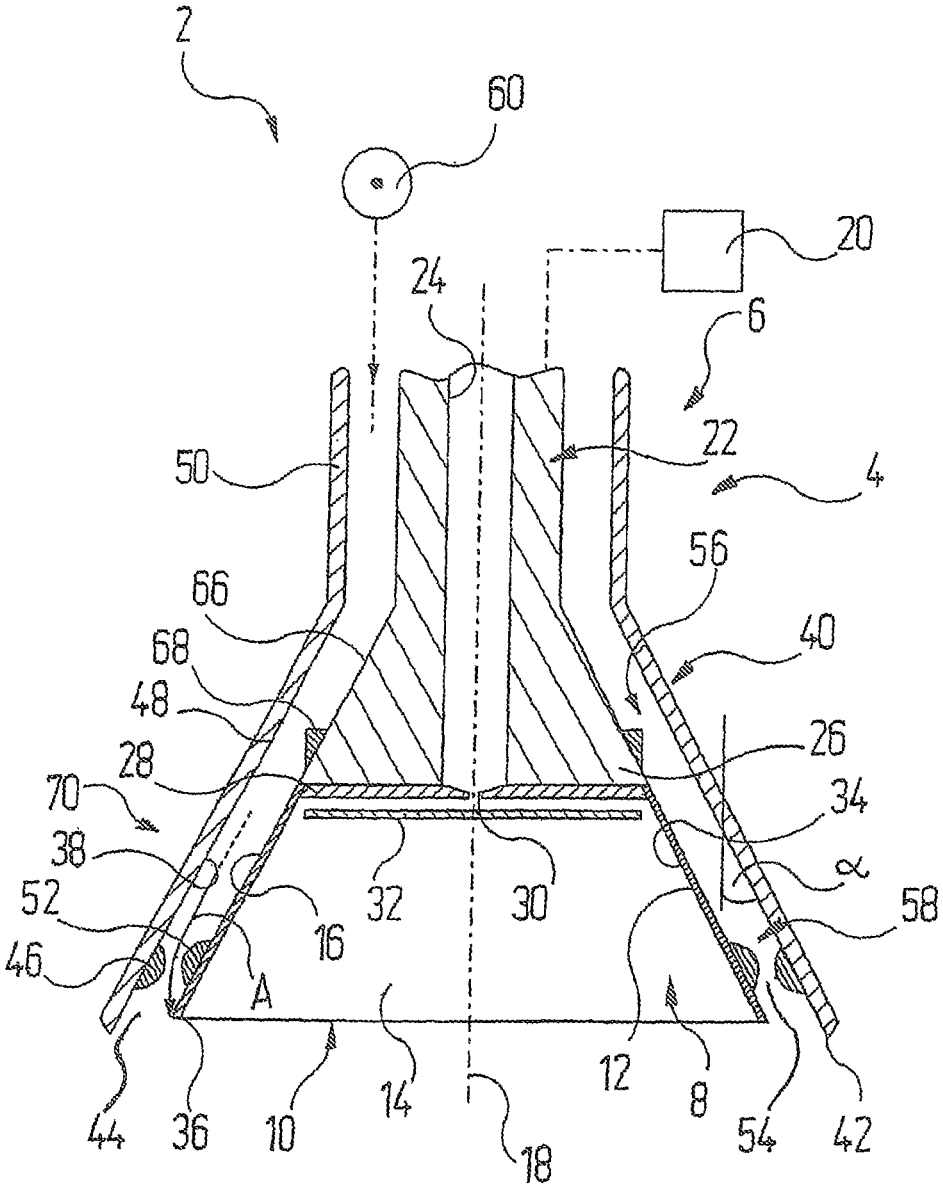
FIG. 1 shows an axial section of a nozzle head of a rotary atomizer having a discharge device for working air according to a first exemplary embodiment, by means of which device a transonic or supersonic flow can be produced.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIG. 1 a rotary atomizer is designated as a whole by 2, of which atomizer only a head section 4 with a nozzle head 6 is shown. By means of the rotary atomizer 2 paint can be applied to an object (not shown specifically).

The nozzle head 6 comprises a rotationally symmetrical bell disc 8. The latter is, in the present exemplary embodiment being described, as a whole formed as a hollow truncated cone 10 with an encircling wall 12 and has a truncated-cone-shaped inner lateral surface 14 and a truncated-cone-shaped outer lateral surface 16. The bell disc 8 may also have geometries which differ therefrom, as are known per se in the case of bell discs from the prior art.

The bell disc 8 is rotatable at high speed about a rotational axis 18, for which purpose the rotary atomizer 2 comprises a drive device 20, which is merely schematically illustrated in the figures. The bell disc 8 may be driven, for example, by means of an electric motor or pneumatically. The bell disc 8 rotates, in operation, at rotational speeds of 10,000 to 100,000 rpm about its rotational axis 18.

The bell disc 8 is carried by the free end of a hollow shaft 22 coaxial with the bell disc 8, which shaft is coupled to the drive device 20 and bounds in the longitudinal direction a paint supply channel 24 which can be fed from a paint reservoir (not shown).

The hollow shaft 22 ends in a fastening flange 26 which runs perpendicularly to the rotational axis 18 and via which the shaft is connected to the bell disc 8. For this purpose, the bell disc 8 comprises an annular plate 28 which is complementary with the fastening flange 26 of the hollow shaft 22 and has a central discharge opening 30, into which opens the paint supply channel 24 in the hollow shaft 22.

The bell disc 8 further comprises, in a manner known per se, a baffle plate 32 which is carried by the annular plate 28. The baffle plate 32 runs perpendicularly to the rotational axis 18 of the bell disc 8 and is arranged at a small spacing from the annular plate 28 in the interior of the bell disc 8. The baffle plate 32 runs radially outwards until it is a short distance from the inner lateral surface 14 of the bell disc 8, which surface serves as a truncated-cone-shaped flow-off surface 34. The outer diameter of this flow-off surface 34 accordingly increases in the direction away from the hollow shaft 22. At the end remote from the hollow shaft 22, the flow-off surface 34 ends in an encircling breakaway edge 36.

The outer lateral surface 16 of the bell disc 8 is surrounded by a conical inner lateral surface 38 of a guiding body formed as a guiding sleeve 40, which is arranged coaxially with the bell disc 8. The guiding sleeve 40 has a free end edge 42 which is arranged radially beside the outer lateral surface 16 of the bell disc 8, so that an annular discharge gap 44 is formed there.

Viewed in the direction from the free end edge 42 inwards, the inner lateral surface 38 of the guiding sleeve 40 has in the circumferential direction an annular prominence 46 curved in the direction towards the outer lateral surface 16 of the bell disc 8, which prominence 46 is borne by the conical wall 48 of the guiding sleeve 40. The conical wall 48 of the guiding sleeve 40 then opens into a hollow-cylindrical carrier 50 with a constant cross-section, which surrounds the hollow shaft 22 and serves for fixing the guiding sleeve 40 to the rotary atomizer 2.

The inner lateral surface 38 of the guiding sleeve 40 is inclined at an angle $\alpha$ with respect to the rotational axis 18. This angle $\alpha$ is thus the cone angle for the inner lateral surface 38 of the guiding sleeve 40, the outer lateral surface of which may also have a course other than conical. The guiding sleeve 40 is stationarily mounted, in terms of rotation, with respect to the rotatable bell disc 8. In a modification, however, the guiding sleeve 40 may also be rotated about the rotational axis 18 by means of a drive (not shown specifically here).

The outer lateral surface 16 of the bell disc 8 has, in the circumferential direction, an annular prominence 52 which lies opposite the prominence 46 of the guiding sleeve 40 and is curved in the direction towards the latter, an annular gap 54 remaining between the prominences 46 and 52.

As a whole, an annular channel 56 is formed between the outer lateral surface 16 of the bell disc 8 and the inner lateral surface 38 of the guiding sleeve 40, the narrowest point of which channel is defined by the annular gap 54.

In the present exemplary embodiment, the angle $\alpha$ of the inner lateral surface 38 of the guiding sleeve 40 is of the same size as the conical angle of the outer lateral surface 16 of the bell disc 8, so that the outer lateral surface 16 of the latter and the inner lateral surface 38 of the guiding sleeve 40 run parallel to one another, and the annular channel 56 has a constant cross-section apart from the annular gap 54. In modifications (not shown specifically) the cone angle of the outer lateral surface 16 of the bell disc 8 and the cone angle $\alpha$ of the inner lateral surface 38 of the guiding sleeve 40 may also differ from one another, so that the annular channel 56 narrows or widens in the direction of the discharge gap 44. This will be discussed again below.

The inner lateral surface 38 of the guiding sleeve 40 having the prominence 46 thus forms with the outer lateral surface 16 of the bell disc 8 having the prominence 52 a Laval nozzle unit in the form of a Laval annular nozzle 58, which comprises the annular discharge gap 44 from which a working fluid is blown onto the coating material separating from the bell disc 8. In this case, the inner lateral surface 38 of the guiding sleeve 40 having the prominence 46 is a first flow surface and the outer lateral surface 16 of the bell disc 8 having the prominence 52 is a second flow surface of the Laval annular nozzle 58, which surfaces lie opposite one another.

In the present exemplary embodiment, air is used as the working fluid, the air being referred to hereinafter as working air. It is, however, also possible to use other gases as the working fluid, instead of air.

As the working air, compressed air is supplied under positive pressure to the annular channel 56 and in this way to the Laval annular nozzle 58 for this purpose, in a manner known per se, from a fluid source in the form of a compressed air source 60, this being illustrated only highly schematically in the figures. The compressed air source 60 may be formed, for example, as a compressor.

Figure 2:
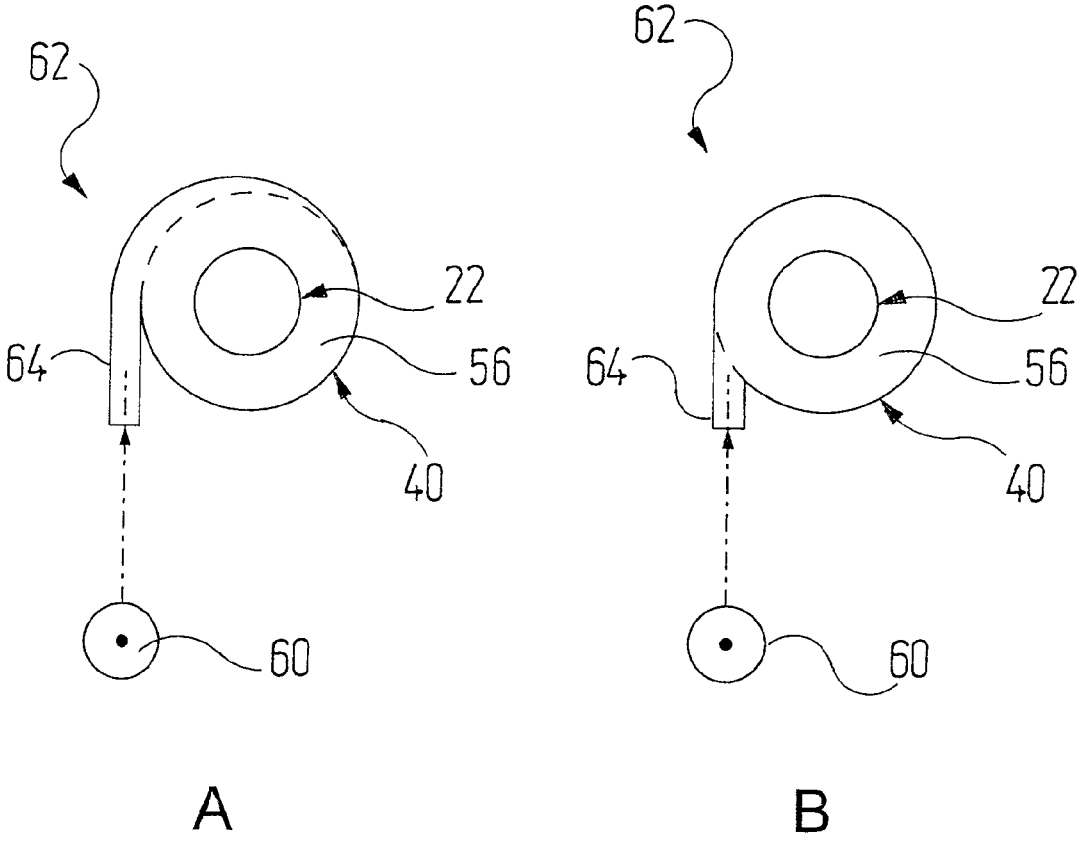
FIGS. 2A and 2B show variants of a swirl device of the nozzle head.

The working air can be supplied to the annular channel 56 with or without swirl. If the working air is to flow into the annular channel 56 with swirl, a swirl device 62 is present. For example, the latter may comprise a supply connecting piece 64 on the hollow-cylindrical carrier 50, via which the working air flows tangentially or partially tangentially into the annular channel 56, as is illustrated in FIGS. 2A and 2B. There, a cross-section transversely to the rotational axis 18 is shown in each case. The resulting swirl of the working air is in this case determined by the setting angle of the tangential or partially tangential supply.

In a modification (not shown specifically), the working air can also flow from the compressed air source 60 via a guiding device into the annular channel 56, which device comprises, for example, air guide grooves or air guide vanes, as is known per se e.g. in the case of hollow cone nozzles. Appropriately obliquely running supply bores in the hollow-cylindrical carrier 50 can also ensure a swirl of the working air in the annular channel 56.

In all cases, the inflow angle of the working air into the annular channel 56 depends on the structural conditions and may be appropriately defined via these.

In order to accelerate still further the working air flowing through the annular channel 56 in the direction of the annular gap 54 and the annular discharge gap 44, the hollow shaft 22 bears guide vanes 68 evenly distributed in the circumferential direction on its outer lateral surface 66. These vanes have such a geometry and are so arranged that working air is conveyed in the direction of the annular discharge gap 44 when the bell disc 8 rotates in the operation of the rotary atomizer 2. The guide vanes 68 can support an existing swirl of the working air or generate a swirl. Overall, the action of the guide vanes 68 depends, in a manner known per se, on their geometry and setting angle.

If a sufficiently high flow speed of the working air can be achieved by the compressed air source 60, the guide vanes 68 may also be dispensed with. On the other hand, the required positive pressure of the working air from the compressed air source 60 may be lower if the guide vanes 68 support the propulsion of the working air to the discharge gap 44, whereby the energy requirement for the operation of the compressed air source 60 can, in turn, be reduced.

The outer lateral surface 66 of the hollow shaft 22 serves at the same time as an air guiding surface and has, in the present exemplary embodiment, a cylindrical region 66*a* beside the hollow-cylindrical carrier 50 and a conical region 66*b* beside the guiding sleeve 40, so that the outer lateral surface 62 of the hollow shaft 22 runs largely parallel to the inner lateral surface 38 of the guiding sleeve 40.

Overall, through the interaction of the components concerned, i.e. through the interaction of the compressed air source 60, optionally the swirl device 62, optionally the guide vanes 68, the annular channel 56, the annular gap 54 and the annular discharge gap 44, a discharge device 70 is present, through which a working fluid can be blown at least temporarily as a transonic or supersonic flow onto the coating material separating from the bell disc 8.

The speed with which the working air is discharged via the annular discharge gap 44, and the effect of the working air on the development of the droplets which are hurled away from the bell disc 8, depend on the interaction of the components of the discharge device 70 concerned. Thus, for example, the discharge pressure of the compressed air source 60 or the volume flow rate of the working air coming from the compressed air source 60, as well as the geometry of the annular channel 56 and of the Laval annular nozzle 58, influence the working air flow.

The working air can also be blown from the discharge device 70 as a supersonic flow onto the coating material separating from the bell disc 8.

The transonic or supersonic flow acts as a so-called impressed disturbance with regard to the coating material. The working air is in this case guided through the Laval annular nozzle 58 in the direction of the breakaway edge 36 of the bell disc 8, this being illustrated by an arrow A, which is shown only on the left in FIG. 1 and is intended to indicate the main flow of the transonic or supersonic flow. At the breakaway edge 36 of the bell disc 8, the transonic or supersonic flow as an impressed disturbance influences the droplet formation in the development process during the formation of jets or lamellae, from which the droplets develop, as was explained at the outset.

If the cone angle $\alpha$ of the inner lateral surface 38 of the guiding sleeve 40 is changed and the annular channel 56 no longer has a constant cross-section, there results a changed flow behaviour of the working air through the annular channel 56 and, with otherwise unchanged prominences 56 and 52, also a changed geometry of the annular gap 54, which influences the outflow of the working air from the Laval annular nozzle 58. For example, the cone angle $\alpha$ may be varied in a range from −15° and +75° relative to the rotational axis 18.

The above-described rotary atomizer 2 now functions as follows:

In the operation of the rotary atomizer 10, the bell disc 8 is rotated about its rotational axis 18 by means of the drive device 20 and the paint supply channel 24 in the hollow shaft 22 is fed with paint.

Paint firstly passes out of the discharge opening 30 in the annular plate 28 of the rotating bell disc 8 and strikes the baffle plate 32 of the latter. On account of the rotation of the bell disc 8, this paint arrives as a paint film at the inner flow-off surface 34 of the latter and travels further forwards to the breakaway edge 36 of the latter, where the paint film separates from the bell disc in the form of jets or lamellae, from which droplets then develop. As mentioned at the outset, it is desirable to produce small droplets.

In the case of a rotary atomizer without the discharge device 70 explained above, the average size of the droplets which are hurled away from the bell disc 8 changes depending on the rotational speed of the bell disc. The lower the rotational speed of the bell disc 8, the larger are the droplets produced. At the same time, however, it is desirable to rotate the bell disc 8 at low rotational speed, in order to save energy.

The discharge device 70 counteracts the undesired effect that, at lower rotational speeds, larger droplets are hurled away from the bell disc 8.

Because now, working air is blown by the discharge device 70 as transonic or supersonic flow from the annular discharge gap 44 onto the coating material at the breakaway edge 36. This working air influences the instability of the jets or lamellae at the breakaway edge 36 in the manner explained above and results in smaller droplets being developed.

Thus, on account of the discharge device 70 and the transonic or supersonic flow produced thereby, sufficiently small droplet sizes can be achieved also at lower rotational speeds of the bell disc 8. In addition, through the transonic or supersonic flow, the average size of the paint droplets hurled away from the breakaway edge 36 of the bell disc 8 is standardised; a spray jet with a comparatively uniform droplet spectrum is formed.

Given equal droplet size, lower rotational speeds can be chosen owing to the impressed disturbance by the working air. On account of the lower rotational speed, the drops do not fly as far outwards in the radial direction.

In this way, the diameter of the paint mist produced by the nozzle head 6 is less than without the discharge device 70 and, at lower rotational speeds of the bell disc 8, the paint mist is also focused effectively onto the object to be painted.

Through the combination of the effect of the working air on the droplet spectrum of the spray jet and the rotational speed with which the bell disc 8 rotates, the geometry and the droplet spectrum of the spray jet can now be set. The smaller the droplets, the less is the radial extent of the spray jet given an unchanged rotational speed of the bell disc 8.

The bell disc can now be rotated at a lower rotational speed compared with a rotary atomizer without a discharge device 70, without the droplet spectrum of the spray jet being affected.

A further parameter which influences the geometry of the spray jet in the interaction with the transonic or supersonic flow is, of course, the fluid volume flow rate with which the coating material is supplied to the bell disc 8, which for its part influences the jet and lamella formation at the breakaway edge 36 of the bell disc 8.

Figure 3:
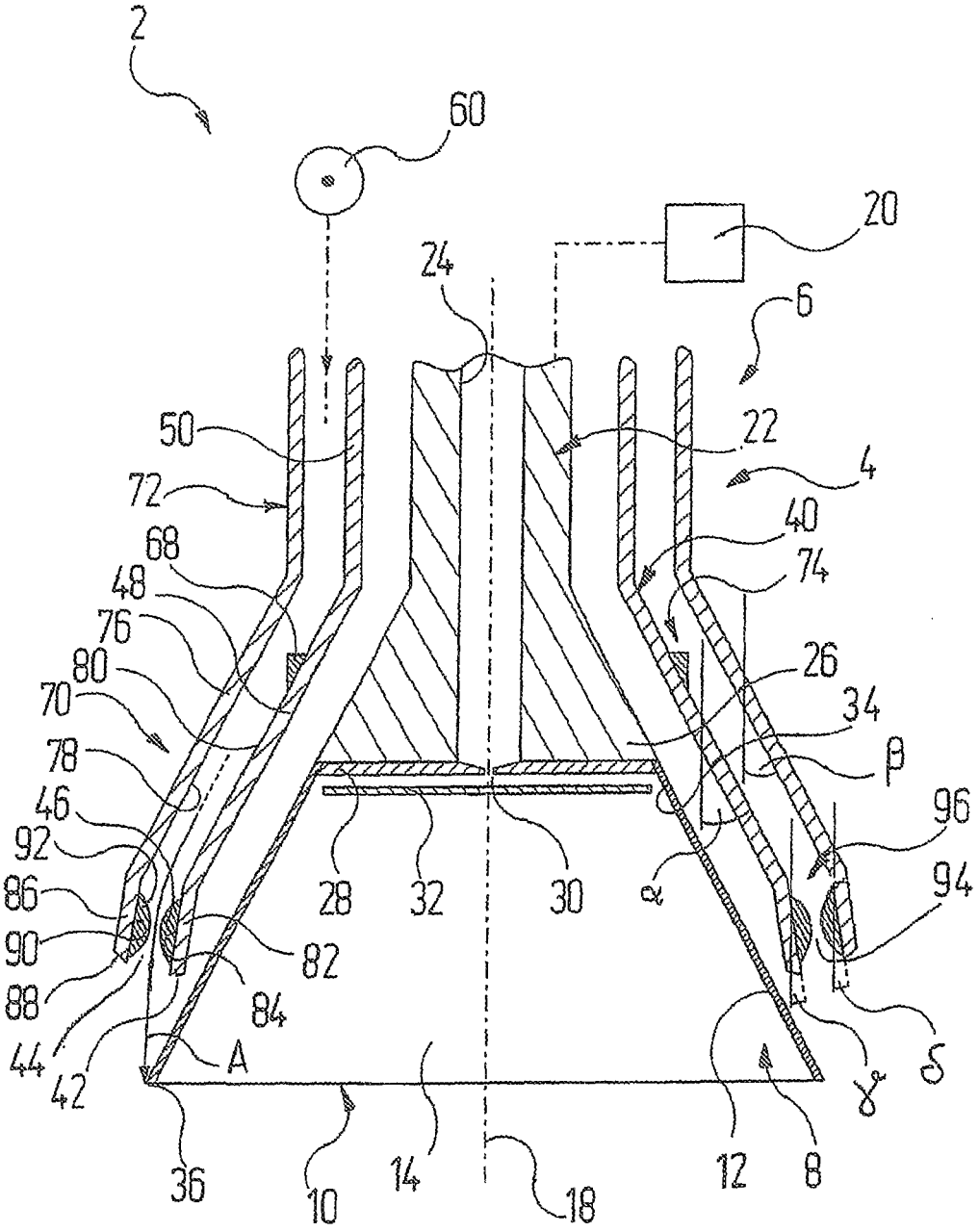
FIG. 3 shows an axial section of a modified nozzle head having a discharge device for working air according to a second exemplary embodiment.

FIG. 3 shows a nozzle head 6 of a rotary atomizer 2 according to a second exemplary embodiment, the main flow direction of the working fluid again being illustrated by an arrow A.

There the guiding sleeve 40 forms an inner guiding sleeve 40 and is surrounded in such a way by an outer, likewise stationarily mounted guiding body in the form of a guiding sleeve 72, that an annular channel 74 remains between the inner guiding sleeve 40 and the outer guiding sleeve 72. The outer guiding sleeve 72 comprises a conical wall 76 with a conical inner lateral surface 78 which is inclined with respect to the rotational axis 18 about a cone angle β. For example, the cone angle β can be varied in a range from −15° and +75° relative to the rotational axis 18.

In a modification, the inner guiding sleeve 40 and/or the outer guiding sleeve 72 can be rotated about the rotational axis 18 by means of drives (not shown specifically here). Thus, both guiding sleeves 40, 72 can be stationarily mounted or rotatable or respectively only one of the two guiding sleeves 40, 72 can be stationarily mounted, while the other guiding sleeve 72 or 40 is rotatable.

The inner guiding sleeve 40 has a conical outer lateral surface 80, the inclination with respect to the rotational axis 18 of which now defines the cone angle α.

The conical wall 48 of the inner guiding sleeve 40 opens, beside the bell disc 8, into an edge section 82, which now defines the end edge 42 of the inner guiding sleeve 40. The edge section 82 has a conical outer lateral surface 84 which for its part is inclined at a cone angle γ with respect to the rotational axis 18. This outer lateral surface 84 of the edge section 82 of the inner guiding sleeve 40 has the prominence 46 of the guiding sleeve 40, which now no longer faces in the direction of the bell disc 8, but in the direction of the outer guiding sleeve 72. The bell disc 8 now no longer has a prominence.

In a corresponding manner, the conical wall 76 of the outer guiding sleeve 72 opens into an edge section 86 which defines a free end edge 88 of the outer guiding sleeve 72. The edge section 86 of the outer guiding sleeve 72 has a conical inner lateral surface 90 which for its part is inclined at a cone angle δ with respect to the rotational axis 18. The inner lateral surface 90 of the edge section 86 of the outer guiding sleeve 72 for its part has in the circumferential direction an annular prominence 92 which is arranged opposite the prominence 46 of the inner guiding sleeve 40, so that an annular gap 94 is formed between the prominences 46 and 92.

The narrowest point of the annular channel 74 between the two guiding sleeves 40 and 72 is thus defined by the annular gap 94. In the exemplary embodiment according to FIG. 3, the angles α and β are equal and of the same size as the cone angle of the outer lateral surface 16 of the bell disc 8. The angles γ and δ are likewise of the same size, but less than the angles α and β, so that the edge sections 82 and 86 of the guiding sleeves 40 and 72 are inclined relative to their conical walls 48 and 76, respectively, in the direction towards the bell disc 8.

The angles γ and δ may be varied, for example, in a range from −90° and +45° relative to the rotational axis 18.

In modifications not shown specifically, the angles α and β as well as the angles γ and δ may also be different from one another, in order to influence the flow of the working air. In the present example, the working air flows via the compressed air source 60 into the annular channel 76 and is blown through the discharge gap 44 onto the coating material at the breakaway edge 36 of the bell disc 8, which is formed here between the free edges 42 and 88 of the guiding sleeves 40 and 72, respectively.

The outer lateral surface 84 of the edge portion 82 of the inner guiding sleeve 40 having the prominence 46 here forms, with the inner lateral surface 90 of the edge section 86 of the outer guiding sleeve 72 having the prominence 92, a Laval nozzle unit in the form of a Laval annular nozzle 96 which comprises the annular discharge gap 44.

To support the flow of the working air through the annular channel 76, here the outer lateral surface 80 of the conical wall 48 of the inner guiding sleeve 40 bears the guide vanes 68.

The inner guiding sleeve 40 can for this purpose be rotated about the rotational axis 18 like the bell disc 8 by means of a dedicated drive (not shown specifically) or by means of the drive 20.

In other respects, the above statements regarding the rotary atomizer 2 according to FIG. 1 apply analogously to the rotary atomizer 2 according to FIG. 3.

Figure 4:
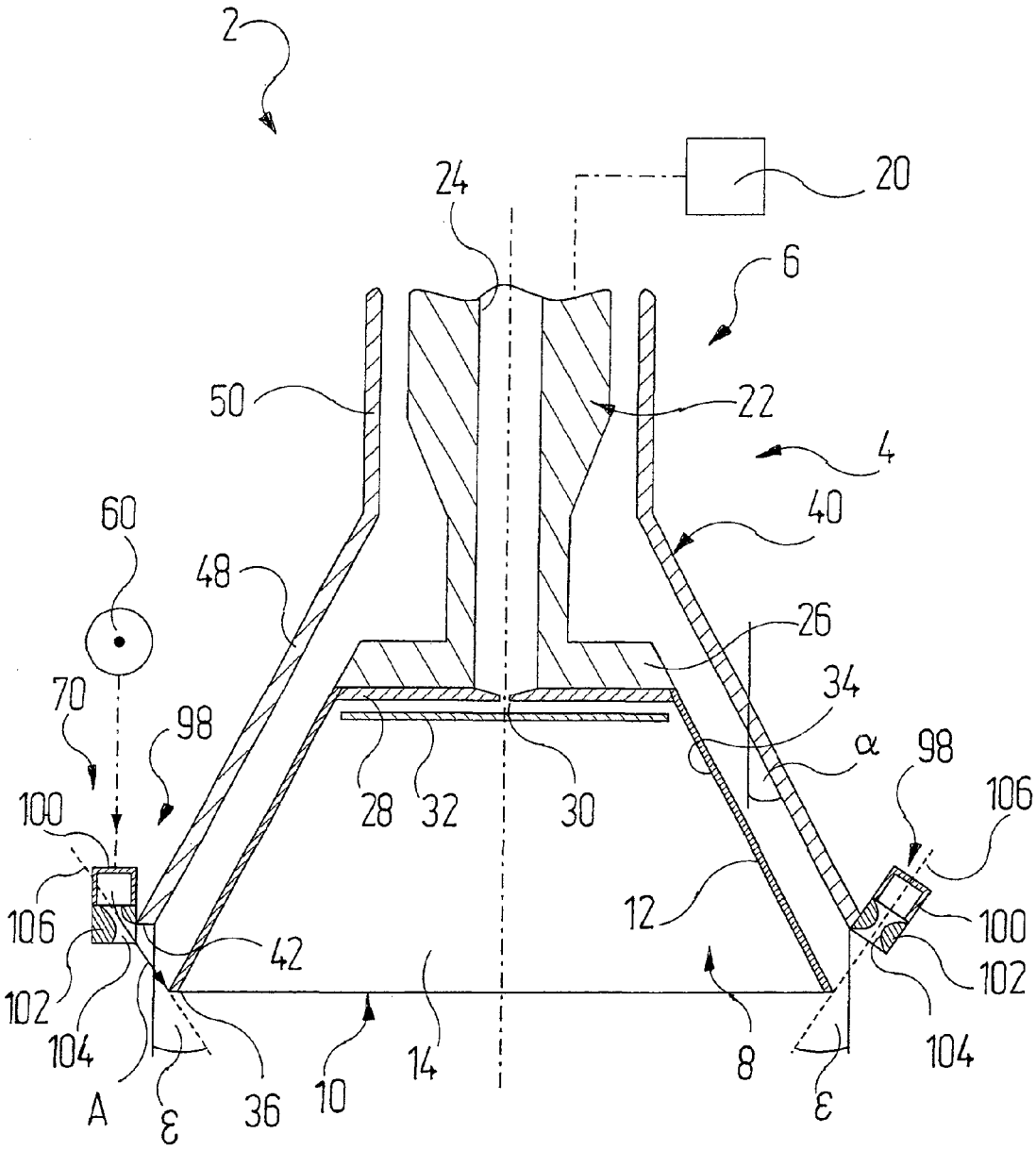
FIG. 4 shows an axial section of a further modified nozzle head having a discharge device for working air according to a third exemplary embodiment.

FIG. 4 shows a further modified nozzle head 6 of a rotary atomizer 2 according to a third exemplary embodiment.

There the bell disc 8 is again surrounded only by the guiding sleeve 40 which, however, carries at its free edge 42 a Laval annular body 98 as the Laval nozzle unit. This Laval annular body 98 may also be integrated into the guiding sleeve 40; optionally a housing enveloping the guiding sleeve 40 and the Laval annular body 98 may be present. The Laval annular body 98 comprises a flow annular space 100, which is supplied with working air from the compressed air source 60. The flow annular space 100 merges at a plane annular surface into an annular nozzle body 102, which has a multiplicity of Laval nozzle openings 104, via which the working air is blown from the Laval annular body 98 as a transonic or supersonic flow onto the coating material at the breakaway edge 36 of the bell disc 8.

At the Laval nozzle openings 104, the passage cross-section for the working air flowing through initially narrows and then widens again in the direction of an outlet side.

The Laval nozzle openings 104 define a longitudinal axis 106 which is tilted with respect to the rotational axis 18 by an angle ϵ. In FIG. 4, by way of example, two variants are shown of the way in which this tilting of the Laval nozzle openings can be achieved. In FIG. 4 on the left there is shown a cross-section of a Laval annular body 98 in which the Laval nozzle openings 104 are tilted with respect to a surface normal of the annular surface of the flow annular space 100. The Laval annular body 98 per se corresponds in this case to a section of a hollow cylinder. The main flow direction of the working fluid is illustrated only in FIG. 4 on the left by an arrow A.

In FIG. 4 on the right, by contrast, there is shown a cross-section of a Laval annular body 98 in which the longitudinal axes 106 of the Laval nozzle openings 104 are coaxial with a respective surface normal of the annular surface of the flow annular space 100. In order to produce the tilting angle ϵ, the Laval annular body 98 is tilted as a whole so that it forms in this case a shallow truncated cone, as illustrated in FIG. 4.

The tilting angle ϵ can be varied, for example, in a range from −45° and +90° relative to the rotational axis 18.

In a modification (not shown specifically), instead of the separate Laval nozzle openings 104, it is also possible for a continuously encircling Laval annular gap to be formed in the nozzle body 102.

In other respects, the above statements regarding the rotary atomizers 2 according to FIGS. 1 and 3 apply analogously to the rotary atomizer 2 according to FIG. 4.

The Laval nozzle openings 104 may furthermore also run obliquely in the circumferential direction, so that in the cross-section shown in FIG. 4 they are tilted with respect to the plane of the paper. In this way, a swirl of the working air can be generated. In this case, the Laval annular body 98 thus acts at the same time as a swirl device.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. Nozzle head for a rotary atomizer for applying a coating material to an object comprising:

a bell disc which is rotatable about a rotational axis and has a flow-off surface which is supplied with coating material in such a way that coating material is hurled away from the bell disc, the bell disc being surround by a guiding body wherein a discharge device is present, by means of which a working fluid is blown at least temporarily as a transonic or supersonic flow onto coating material coming from the bell disc, and an outer lateral surface of the bell has a first annular prominence formed thereon and an inner lateral surface of the guiding body has a second annular prominence formed thereon, the prominences being configured opposite each other and defining an annular gap there between.

2. Nozzle head according to claim 1, wherein the first annular prominence and the second annular prominence form a Laval annular nozzle which blows the working fluid in the direction of a breakaway edge of the bell disc.

3. Nozzle head according to claim 1, wherein the first annular prominence and the second annular prominence form a Laval annular nozzle which blows the working fluid onto coating material separating from a breakaway edge of the bell disc.

4. Nozzle head according to claim 1, wherein the annular gap comprises a Laval nozzle unit having an annular discharge gap or a plurality of discharge openings.

5. Nozzle head according to claim 4, wherein a fluid source is present, from which the Laval nozzle unit is supplied with the working fluid under positive pressure.

6. Nozzle head according to claim 1, wherein an annular channel is present between the bell disc and the guiding body, the annular channel being wider than the annular gap.

7. Nozzle head according to claim 1, wherein the outer lateral surface of the bell disc forms a truncated cone surface.

8. Rotary atomizer for applying a coating material to an object having a nozzle head wherein, the nozzle head is formed according to claim 1.

9. Nozzle head according to claim 1, wherein in an annular channel present there are arranged guide vanes which are configured such that, on rotation of one or more of the bell disc and a guiding body, working fluid situated in the annular channel is conveyed to the annular gap.

* * * * *